United States Patent [19]

Ueda et al.

[11] Patent Number: 4,669,627

[45] Date of Patent: Jun. 2, 1987

[54] SEALED CONTAINER

[75] Inventors: Kazuo Ueda, Tokyo; Katsuhiro Joo, Tokushima, both of Japan

[73] Assignee: Shikoku Kakooki Co., Ltd., Tokushima, Japan

[21] Appl. No.: 866,508

[22] Filed: May 23, 1986

[30] Foreign Application Priority Data

Sep. 30, 1985 [JP] Japan ..... 60-150164[U]

[51] Int. Cl.[4] ..... B65D 25/00

[52] U.S. Cl. ..... 220/94 R; 229/52 A; 294/27.1; 16/114 R; 220/71

[58] Field of Search ..... 220/94 R, 96, 71; 229/52 A, 52 AH; 16/110.5, 114 R; 294/27.1, 137

[56] References Cited

U.S. PATENT DOCUMENTS

| | | | |
|---|---|---|---|
| 2,775,373 | 12/1956 | Coralline | 229/52 A |
| 2,810,503 | 10/1957 | Krueger | 220/94 R X |
| 3,056,622 | 10/1962 | Hilderbrandt et al. | 220/94 R X |
| 3,073,493 | 1/1963 | Pfaffenberger | 229/52 A |

*Primary Examiner*—Steven M. Pollard
*Attorney, Agent, or Firm*—Armstrong, Nikaido, Marmelstein & Kubovcik

[57] ABSTRACT

A sealed container comprising a body having a rectangular to square cross section, and an upper reinforcement frame, an intermediate reinforcement frame and a lower reinforcement frame fitting around the body and spaced apart from one another, each of the frames being in the form of a ring conforming to the outer periphery of the body. The intermediate reinforcement frame comprises segments removably joined to one another and including one or two handle forming segments. The handle forming segment is approximately U-shaped when seen from above. The upper reinforcement frame has an upper segment attaching portion, and the lower reinforcement frame has a lower segment attaching portion positioned below the upper attaching portion, so that the handle forming segment(s) can be attached to and interconnect the upper and lower reinforcement frames.

19 Claims, 8 Drawing Figures

SEALED CONTAINER

The present invention relates to sealed containers for packaging fluid foods such as milk and juice.

Conventional containers of this type are usually prepared from laminates made chiefly of paper. Such laminate containers have widely varying sizes ranging from about 500 c.c. to 1 gallon or about 4 liters in capacity. Of these containers, those of relatively small sizes are usable generally satisfactorily, but those of large sizes have the following problems. First, the large container is prone to deformation such as swelling of its body due to heavy contents, and is likely to permit leakage of the contents, for example, when subjected to impact during transport. This may be prevented by using paper of increased thickness, but an increased material cost will then result. Second, the container needs to be held with both hands when the contents are to be poured out and is therefore much more inconvenient than those which can be handled by one hand. The inconvenience may be obviated by attaching a handle to the container, whereas the handle will then become an obstacle when containers are transported for distribution. Moreover, the handle attached renders the container costly.

The main object of the present invention is to provide a sealed container free of all the foregoing drawbacks.

The present invention provides a sealed container comprising a body having a quadrilateral cross section, and an upper reinforcement frame, an intermediate reinforcement frame and a lower reinforcement frame fitting around the body and spaced apart from one another, each of the reinforcement frames being in the form of a ring conforming to the outer periphery of the body, the intermediate reinforcement frame comprising a plurality of segments including two handle forming segments, the handle forming segments being opposed to each other and approximately U-shaped when seen from above, the handle forming segments being removably fitted to the other segments at each end so as to be separable from said other segments, the upper reinforcement frame being provided with an upper segment attaching portion, the lower reinforcement frame being provided with a lower segment attaching portion positioned below the upper segment attaching portion so that the handle forming segments as arranged in parallel with each other can be attached to and interconnect the upper and lower reinforcement frames.

According to the present invention, the upper, intermediate and lower reinforcement frames fitted around the body preclude swelling or like deformation of the body. When the contents are to be poured out, the handle forming segments are removed from the intermediate frame, attached to the upper and lower reinforcement frames and used as a handle for holding the container with one hand. Since the handle forming segments are fitted around the body during the transport of the container, these segments will not become an obstacle.

The reinforcement frames for preventing the deformation of the container make it possible to use a material of reduced thickness for forming the body. The reduction in the thickness leads to a corresponding reduction in the material cost.

Embodiments of the present invention will be described below in greater detail with reference to the accompanying drawings, in which.

Figure 1:
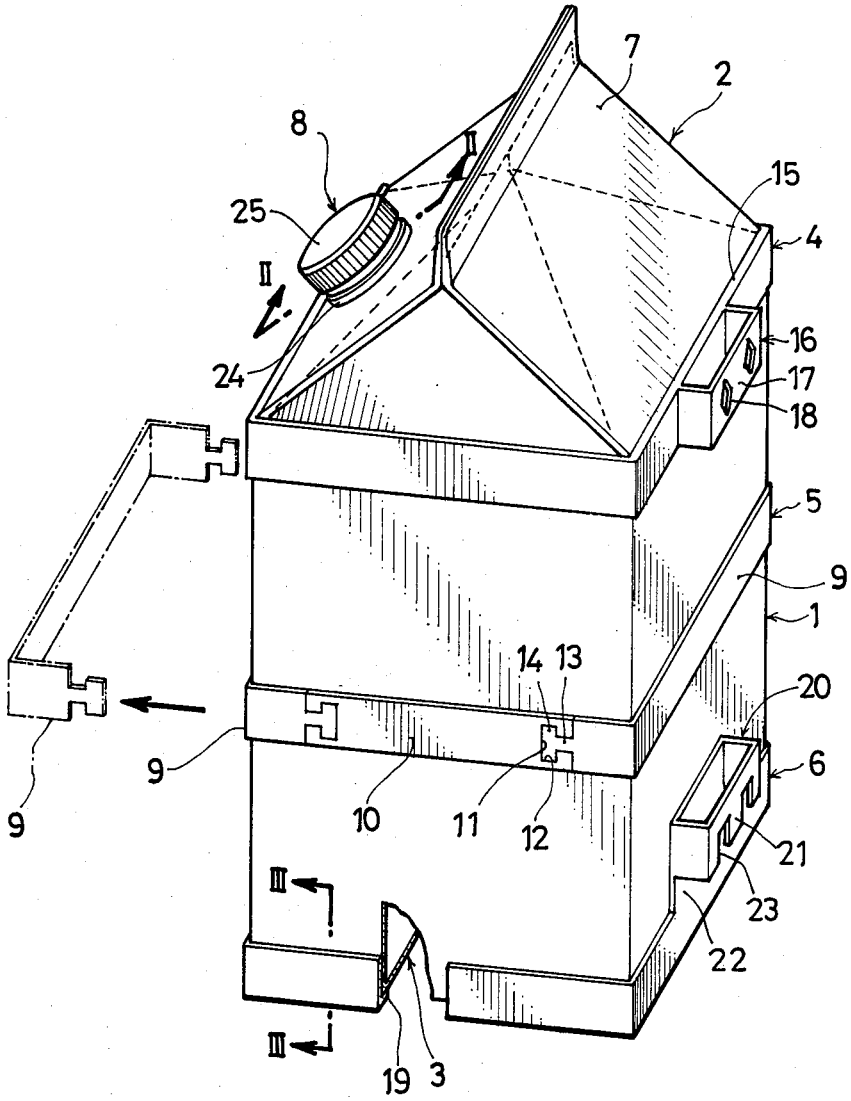
FIG. 1 is a perspective view showing a sealed container embodying the invention.

The sealed container shown in FIGS. 1 to 5 is integrally formed from a laminate material composed primarily of paper and having a thermoplastic resin layer on each side. The container comprises a body 1 having a square cross section, a top closure 2 in the form of a gable roof extending from the upper end of the body 1, and a flat bottom closure 3 continuous with the lower end of the body 1. The container has a capacity of one gallon. More specifically, the body 1 is 150 mm square in cross section and has a height of 200 mm. The body 1 has fitted therearound an upper reinforcement frame 4, an intermediate reinforcement frame 5 and a lower reinforcement frame 6 arranged downward and spaced apart from one another. The top closure 2 includes a top wall 7 having an inverted V-shaped vertical section. The top wall 7 has two sloping portions; one on the front side of the container and the other on the rear side thereof. Spout means 8 is mounted on the front sloping portion.

Figure 2:
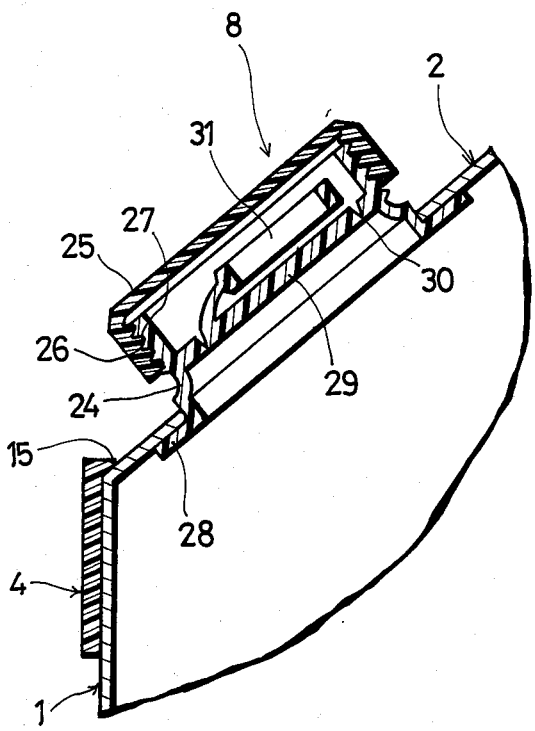
FIGS. 2 and 3 are fragmentary enlarged views in section taken along the line II—II and the line III—III, respectively, in FIG. 1.
Figure 3:
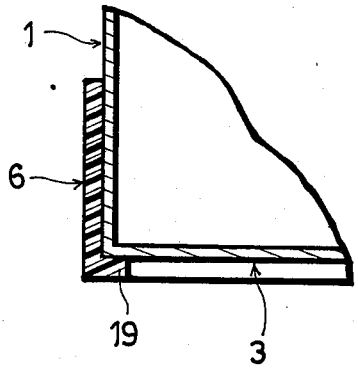

The reinforcement frames 4 to 6 are made of a synthetic resin, such as thermoplastic resin, and are in the form of a ring conforming to the outer periphery of the body 1. Each of the frames extends along the outer periphery of the body 1 and is attached thereto at a plurality of locations with a hotmelt adhesive applied in the form of spots. Of the reinforcement frames 4 to 6, the upper and lower reinforcement frames 4 and 6 are each molded in the form of a single piece, while the intermediate reinforcement frame 5 comprises the combination of four segments, i.e., two first segments 9 and two second segments 10. The first segments 9 are opposed to each other on opposite sides of the body 1 and are U-shaped when seen from above. The second segments 10 are each in the form of a straight strip and interconnect the opposed ends of the first segments 9. The first and second segments 9 and 10 have the same and uniform width. As will be described later, the first segments 9 provide a handle. The first segment 9 has a tenon portion 13 at each end, while the second segment 10 has a mortise portion 11 at each end. The tenon portion 13 has at its forward end a pair of outward engaging projections 14 projecting widthwise of the segment 9. The mortise portion 11 has at its base end a pair of inward engaging recesses 12 having the outward projections 14 engaged therein. As shown in FIG. 2, the upper reinforcement frame 4 has an inward upper edge 15 extending over the entire perimeter thereof along the top closure 2. At the lengthwise midportion of the upper reinforcement frame 4 on the rear side of the body 1, the frame 4 is provided with an upper segment attaching portion 16 having a U-shaped horizontal section and including a vertical engaging wall 17. Provided between the wall 17 and the frame 4 is a space for accommodating the outward engaging projections 14 at the forward end of the tenon portion 13. The engaging wall 17 is formed with two upwardly and downwardly elongated holes 18 arranged side by side at a pitch approximately equal to the width of the first segment 9. The elongated hole 18 has a length slightly larger than the largest width of the tenon portion 13 including the outward engaging projections 14 and a width largest at the midpoint of its length and progressively decreasing upward and downward from the midpoint. The largest width of the hole 18 is smaller than the largest width of the tenon portion 13 including the outward engaging projections 14 and slightly larger than the width of the tenon portion 13 exclusive of the projections 14. As shown in FIG. 3, the lower reinforcement frame 6 has an inward lower edge 19 extending over the entire primeter thereof along the bottom closure 3. The lower reinforcement frame 6 is provided with a lower segment attaching portion 20 positioned immediately below the upper segment attaching portion 16. Like the upper attaching portion 16, the lower attaching portion 20 has a U-shaped horizontal section and includes a vertical engaging wall 21. The lower attaching portion 20 is provided on a wall 22 projecting upward from the frame 6. The engaging wall 21 of the portion 20 is formed in its lower edge with two cutouts 23 arranged side by side at the same pitch as the two elongated holes 18. The cutout 23 is substantially square when seen from front and has a width equal to the largest width of the elongated hole 18.

As shown in detail in FIG. 2, the spout means 8 comprises a tubular member 24 fitted in a hole in the top wall 7 and projecting upward from the wall 7, and a cap 25 fitted over the upper end of the member 24. The tubular member 24 is externally threaded as at 26, and the cap 25 is internally threaded as at 27, whereby the cap 25 is screwed on the tubular member 24. The tubular member 24 is provided at its lower end with a flange 28 heat-sealed to the inner surface of the top wall 7. The tubular member 24 has in its interior a closure wall 29 provided with an annular portion 30 of a reduced thickness. The wall 29 is integrally formed with a knob ring 31 positioned inwardly of the annular portion 30 in proximity thereto.

To open the container, the cap 25 is removed from the tubular member 24 of the spout means 8, and the knob 31 is pulled, whereby the annular portion 30 of reduced thickness is ruptured, forming an opening inside thereof. The container is of course closable again by fitting the cap 25 over the tubular member 24. Before the contents are poured out from the opening thus formed, the two first segments 9 are removed from the intermediate reinforcement frame 5 and then attached to the upper and lower reinforcement frames 4 and 6 in an interconnecting fashion to use the first segments 9 as a handle for holding the container. Each of the first segments 9 is removed from the frame 5 by moving the opposite ends of the segment 9 away from each other and thereby releasing the end tenon portions 13 from the mortise portions 11. The two first segments 9 thus removed are attached first to the upper of the upper and lower reinforcement frames 4, 6 by arranging the two segments 9 laterally in alignment as seen in detail in FIG. 4, inserting the opposed end tenon portions 13 into the elongated holes 18 to pass the outward engaging projections 14 through the holes 18 and then rotating the two segments 9 through 90 degrees in directions in which their free ends move toward each other. This causes the opposed inner edges of the wall 17 defining the holes 18 to engage the projections 14 of the tenon portions 13. Next, the free ends of the segments 9 are attached to the lower reinforcement frame 6 by slightly unfolding these ends downward to position the remaining tenon portions 13 below the engaging wall 21 of the frame 6, and bending the free ends to fit the tenon portions 13 into the cutouts 23 from below. FIG. 5 shows the two segments 9 as attached to the upper and lower reinforcement frames 4, 6 in an interconnecting fashion.

Figure 6:
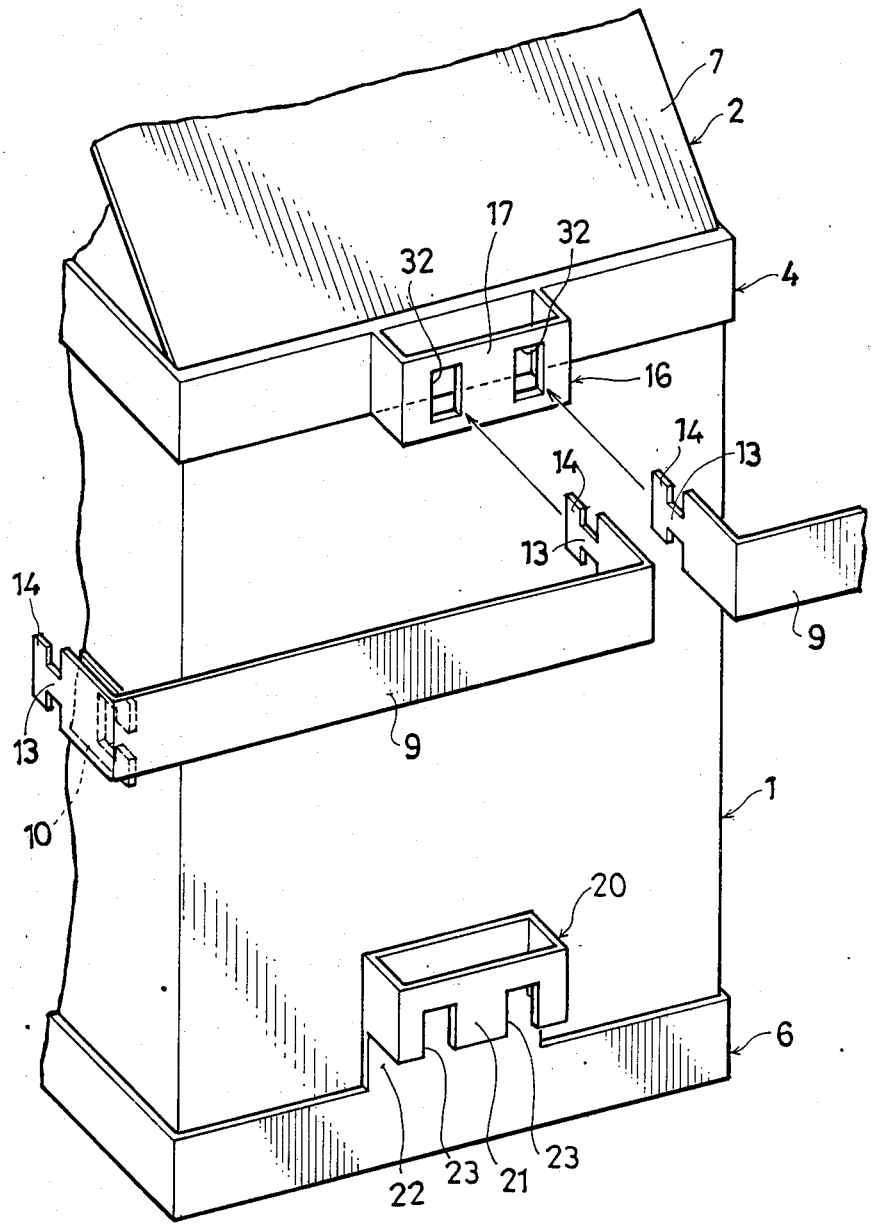
FIG. 6 is a fragmentary enlarged perspective view corresponding to FIG. 4 and showing another sealed container embodying the invention.

FIG. 6 shows another sealed container embodying the invention. With this embodiment, two elongated holes 32 formed in the engaging wall 17 of the upper segment attaching portion 16 have a length equal to that of the holes 18 and a width which is constant over the entire length thereof and is equal to the largest width of the holes 18.

Figure 7:
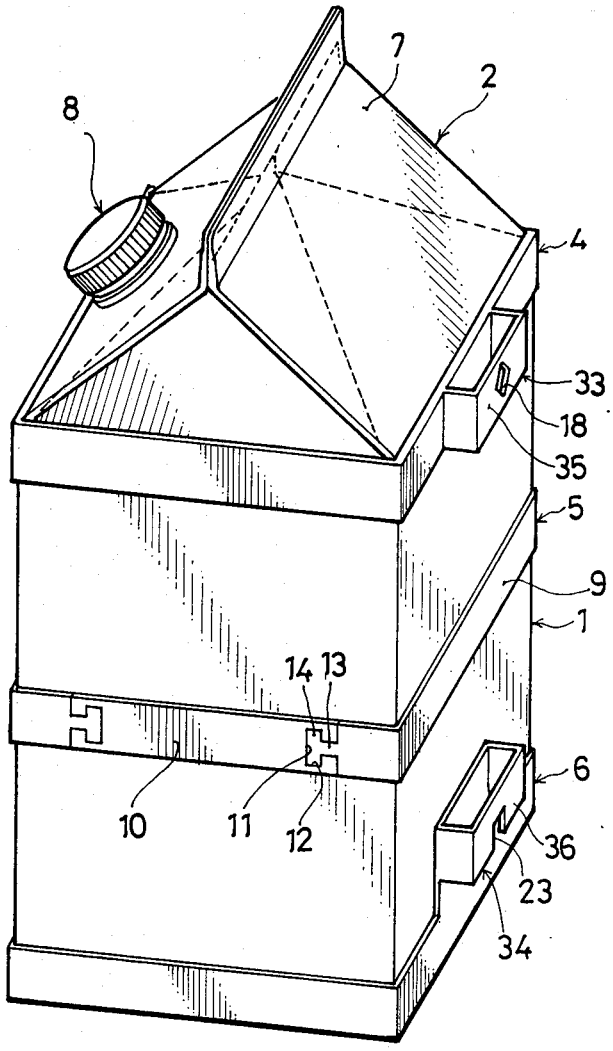
FIGS. 7 and 8 are perspective views corresponding to FIG. 4 and showing other sealed containers embodying the present invention.

FIG. 7 shows another embodiment, in which only one of two handle forming segments 9 is adapted to interconnect upper and lower reinforcement frames 4 and 6 as attached thereto. Accordingly, the engaging wall 35 of an upper segment attaching portion 33 has one elongated hole 18, and the engaging wall 36 of a lower segment attaching portion 34 has one cutout 23.

Figure 8:
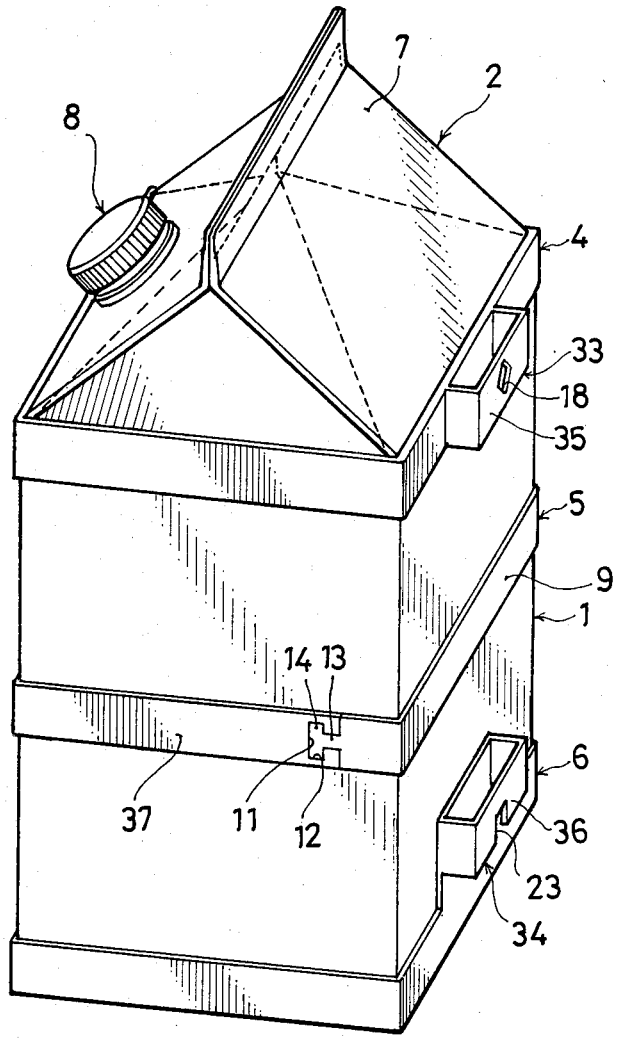

FIG. 8 shows another embodiment, in which the intermediate reinforcement frame 5 consists of one handle forming segment 9 and one segment 37. The single handle forming segment 9 is adapted to interconnect the upper and lower reinforcement frames 4, 6 as attached thereto. These frames have upper and lower segment attaching portions 33 and 34 which are identical with those of the embodiment of FIG. 7 in shape.

Figure 4:
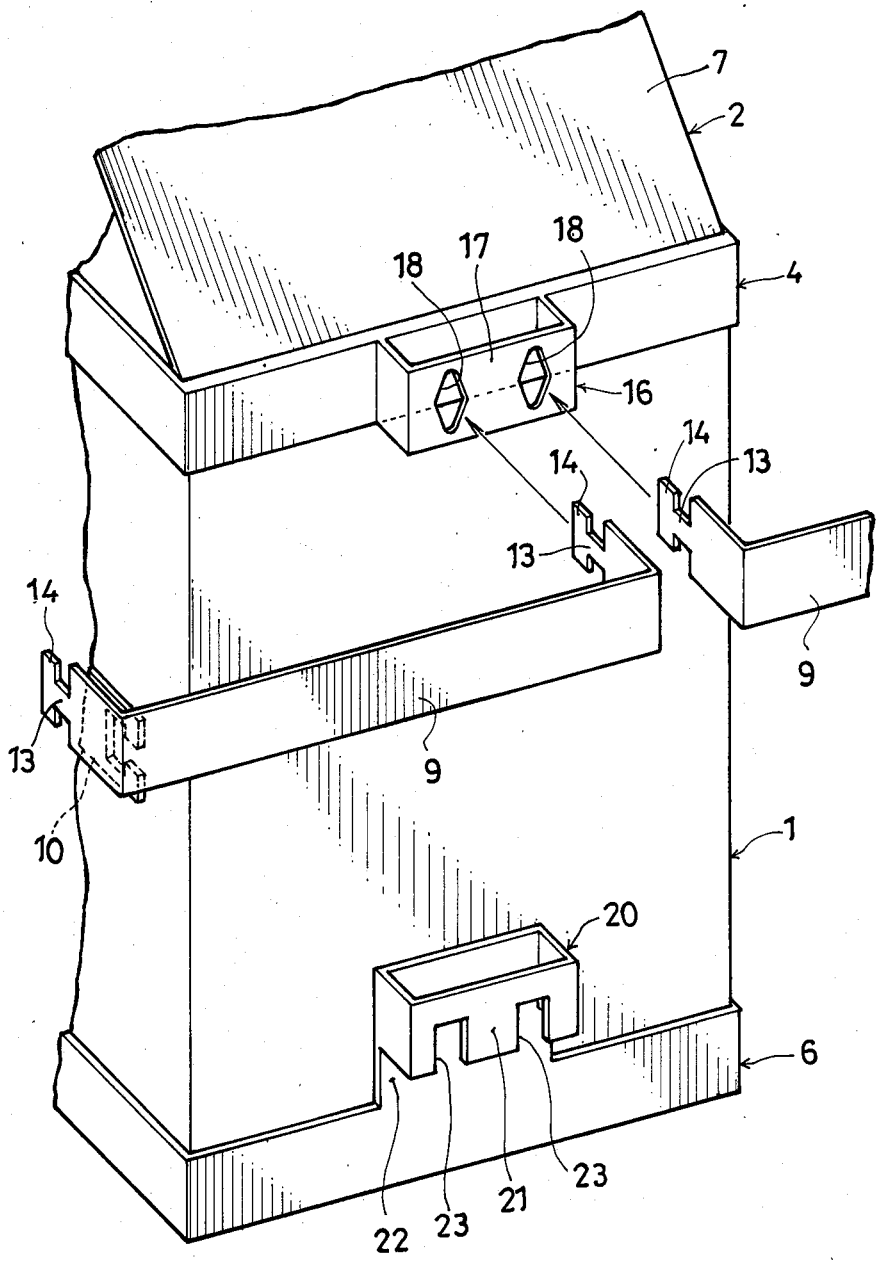
FIGS. 4 and 5 are fragmentary enlarged perspective views showing how to use the container.
Figure 5:
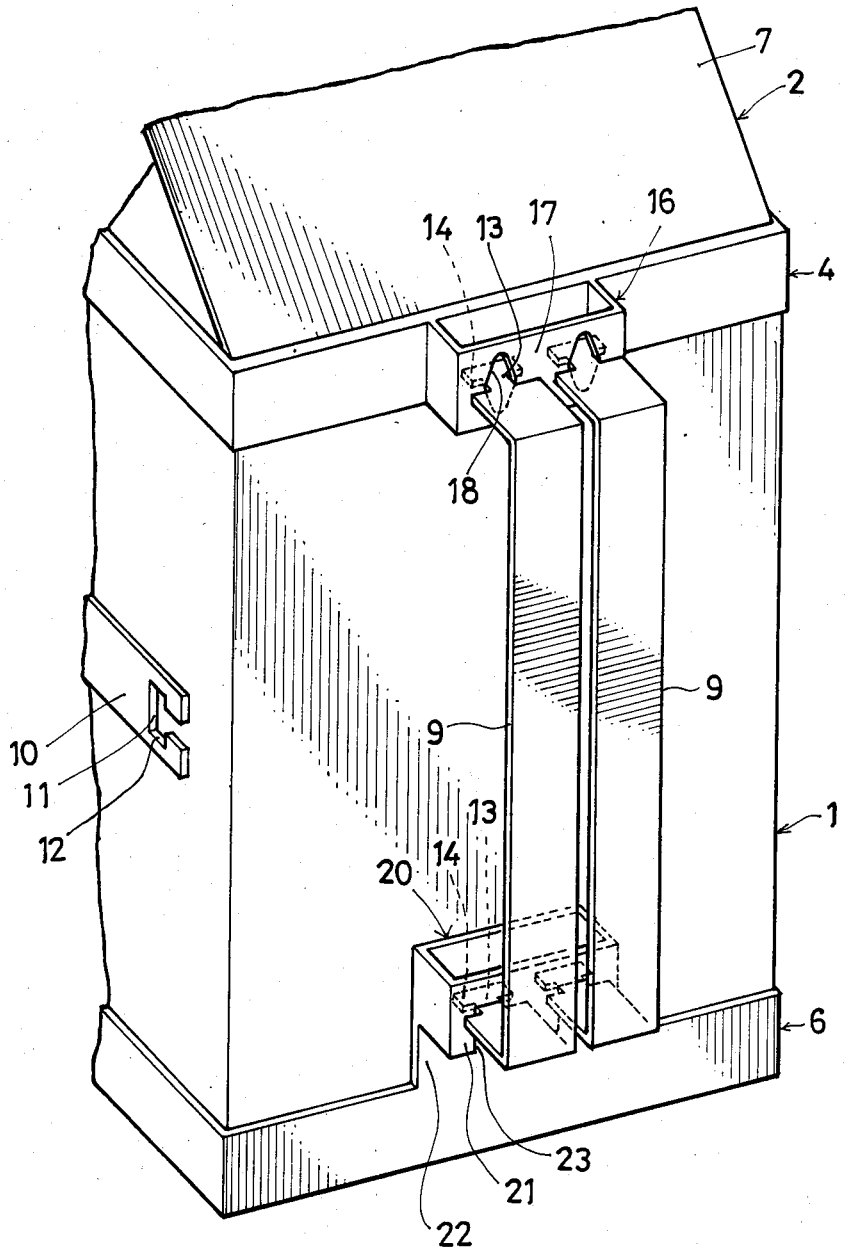

The elongated holes 18 shown in FIGS. 7 and 8, although having the same shape as those of FIGS. 1, 4 and 5, may of course have the same shape as the holes 32 shown in FIG. 6.

We claim:

1. A sealed container comprising a body having a quadrilateral cross section, and an upper reinforcement frame, an intermediate reinforcement frame and a lower reinforcement frame fitting around the body and spaced apart from one another, each of the reinforcement frames being in the form of a ring conforming to the outer periphery of the body, the intermediate reinforcement frame comprising a plurality of segments including two handle forming segments, the handle forming segments being opposed to each other and approximately U-shaped when seen from above, the handle forming segments being removably fitted to the other segments at each end so as to be separable from said other segments, the upper reinforcement frame being provided with an upper segment attaching portion, the lower reinforcement frame being provided with a lower segment attaching portion positioned below the upper segment attaching portion so that the handle forming segments as arranged in parallel with each other can be attached to and interconnect the upper and lower reinforcement frames.

2. A sealed container as defined in claim 1 wherein each of the handle forming segment has a tenon portion at each end thereof, and each of said other segments has a mortise portion at each end thereof, the tenon portion having at its forward end a pair of outward engaging projections projecting widthwise of the segment, the mortise portion having at its base end a pair of inward engaging recesses having the outward projections engaged therein.

3. A sealed container as defined in claim 2 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with two upwardly and downwardly elongated holes arranged side by side, the elongated holes having a length larger than the largest width of the tenon portion including the outward engaging projections and a width largest at the midpoint of the length and progressively decreasing upward and downward from the midpoint, the largest width of the elongated holes being smaller than the largest width of the tenon portion including the outward engaging projections and larger than the smallest width of the tenon portion exclusive of the outward engaging projections, the lower engaging wall being formed in its lower edge with two cutouts at the same pitch as the two elongated holes, the cutouts having a width equal over the entire length thereof to the largest width of the elongated holes.

4. A sealed container as defined in claim 2 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with two vertically elongated holes arranged side by side, the elongated holes having a length larger than the largest width of the tenon portion including the outward engaging projections and a constant width over the entire length, the width of the elongated holes being smaller than the largest width of the tenon portion including the outward engaging projections and larger than the smallest width of the tenon portion exclusive of the outward engaging projections, the lower engaging wall being formed in its lower edge with two cutouts at the same pitch as the two elongated holes, the cutouts having a width equal over the entire length thereof to the width of the elongated holes.

5. A sealed container comprising a body having a quadrilateral cross section, and an upper reinforcement frame, an intermediate reinforcement frame and a lower reinforcement frame fitting around the body and spaced apart from one another, each of the reinforcement frames being in the form of a ring conforming to the outer periphery of the body, the intermediate reinforcement frame comprising two segments including one handle forming segment, the handle forming segment being approximately U-shaped when seen from above, the handle forming segment being removably fitted to the outer segment at each end so as to be separable from the other segment, the upper reinforcement frame being provided with an upper segment attaching portion, the lower reinforcement frame being provided with a lower segment attaching portion positioned below the upper segment attaching portion so that the handle forming segment can be attached to and interconnect the upper and lower reinforcement frames.

6. A sealed container as defined in claim 5 wherein the handle forming segment has a tenon portion at each end thereof, and the other segment has a mortise portion at each end thereof, the tenon portion having at its forward end a pair of outward engaging projections projecting widthwise of the segment, the mortise portion having at its base end a pair of inward engaging recesses having the outward projections engaged therein.

7. A sealed container as defined in claim 6 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with one upwardly and downwardly elongated hole, the elongated hole having a length larger than the largest width of the tenon portion including the outward engaging projections and a width largest at the midpoint of the length and progressively decreasing upward and downward from the midpoint, the largest width of the elongated hole being smaller than the largest width of the tenon portion including the outward engaging projections and larger than the smallest width of the tenon portion exclusive of the outward engaging projections, the lower engaging wall being formed in its lower edge with one cutout having a width equal over the entire length thereof to the largest width of the elongated hole.

8. A sealed container as defined in claim 6 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with one vertically elongated hole, the elongated hole having a length larger than the largest width of the tenon portion including the outward engaging projections and a constant width over the entire length, the width of the elongated hole being smaller than the largest width of the tenon portion including the outward engaging projections and larger than the smallest width of the tenon portion exclusive of the outward engaging propjections, the lower engaging wall being formed in its lower edge with one cutout having a width equal over the entire length thereof to the width of the elongated hole.

9. A sealed container as defined in any one of claims 1 to 8 wherein the body is made of a laminate material composed primarily of paper and having a thermoplastic synthetic resin outer layer, and the upper, intermediate and lower reinforcement frames are made of a thermoplastic resin and are each attached at a plurality of locations lengthwise thereof to the outer surface of the body with a hotmelt adhesive applied in the form of spots.

10. A sealed container comprising a body having a quadrilateral cross section, a top closure generally in the form of a roof and provided at the upper end of the body, and a flat bottom closure provided at the lower end of the body, the top closure including a top wall having an inverted V-shaped vertical section and continuous with a pair of opposed edges of the upper end opening of the body, spout means being provided on one of two sloping portions of the top wall, the body having fitted therearound an upper reinforcement frame, an intermediate reinforcement frame and a lower reinforcement frame spaced apart from one another, each of the reinforcement frames being in the form of a ring conforming to the outer periphery of the body, the intermediate reinforcement frame comprising a plurality of segments including two handle forming segments, the handle forming segments being opposed to each other and approximately U-shaped when seen from above, the handle forming segments being removably fitted to the other segments at each end so as to be separable from said other segments, an upper segment attaching portion being provided on the outer surface of the upper reinforcement frame and positioned on the body side continuous with the other slanting portion of the top wall, a lower segment attaching portion being provided on the outer surface of the lower reinforcement frame and positioned below the upper segment attaching portion, so that the handle forming segments, as arranged in parallel with each other and opposed to the spout means, can be attached to and interconnect the upper and lower reinforcement frames.

11. A sealed container as defined in claim 10 wherein each of the handle forming segment has a tenon portion at each end thereof, and each of said other segments has a mortise portion at each end thereof, the tenon portion having at its forward end a pair of outward engaging projections projecting widthwise of the segment, the mortise portion having at its base end a pair of inward engaging recesses having the outward projections engaged therein.

12. A sealed container as defined in claim 11 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with two upwardly and downwardly elongated holes arranged side by side, the elongated holes having a length larger than the largest width of the tenon portion including the outward engaging projections and width largest at the midpoint of the length and progressively decreasing upward and downward from the midpoint, the largest width of the elongated holes being smaller than the largest width of the tenon portion including the outward engaging projections and larger than the smallest width of the tenon portion exclusive of the outward engaging projections, the lower engaging wall being formed in its lower edge with two cutouts at the same pitch as the two elongated holes, the cutouts having a width equal over the entire length thereof to the largest width of the elongated holes.

13. A sealed container as defined in claim 11 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with two vertically elongated holes arranged side by side, the elongated holes having a length larger than the largest width of the tenon portion including the outward engaging projections and a constant width over the entire length, the width of the elongated holes being smaller than the largest width of the tenon portion including the outward engaging projections and larger than the smallest width of the tenon portion exclusive of the outward engaging projections, the lower engaging wall being formed in its lower edge with two cutouts at the same pitch as the two elongated holes, the cutouts having a width equal over the entire length thereof to the width of the elongated holes.

14. A sealed container comprising a body having a quadrilateral cross section, a top closure generally in the form of a roof and provided at the upper end of the body, and a flat bottom closure provided at the lower end of the body, the top closure including a top wall having an inverted V-shaped vertical section and continuous with a pair of opposed edges of the upper end opening of the body, spout means being provided on one of two sloping portions of the top wall, the body having fitted therearound an upper reinforcement frame, an intermediate reinforcement frame and a lower reinforcement frame spaced apart from one enother, each of the reinforcement frames being in the form of a ring conforming to the outer periphery of the body, the intermediate reinforcement frame comprising two segments including one handle forming segment, the handle forming segment being approximately U-shaped when seen from above, the handle forming segment being removably fitted to the outer segment at each end so as to be separable from the other segment, an upper segment attaching portion being provided on the outer surface of the upper reinforcement frame and positioned on the body side continuous with the other slanting portion of the top wall, a lower segment attaching portion being provided on the outer surface of the lower reinforcement frame and positioned below the upper segment attaching portion, so that the handle forming segment as opposed to the spout means can be attached to and interconnect the upper and lower reinforcement frames.

15. A sealed container as defined in claim 14 wherein the handle forming segment has a tenon portion at each end thereof, and the other segment has a mortise portion at each end thereof, the tenon portion having at its forward end a pair of outward engaging projections projecting widthwise of the segment, the mortise portion having at its base end a pair of inward engaging recesses having the outward projections engaged therein.

16. A sealed container as defined in claim 15 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with one upwardly and downwardly elongated hole, the elongated hole having a length larger than the largest width of the tenon portion including the outward engaging projections and a width largest at the midpoint of the length and progressively decreasing upward and downward from the midpoint, the largest width of the elongated hole being smaller than the largest width of the tenon portion including the outward engaging projections and larger than the smallest width of the tenon portion exclusive of the outward engaging projections, the lower engaging wall being formed in its lower edge with one cutout having a width equal over the entire length thereof to the largest width of the elongated hole.

17. A sealed container as defined in claim 15 wherein the upper and lower attaching portions have an upper engaging wall and a lower engaging wall opposed to the outer surface of the upper reinforcement frame and the outer surface of the lower reinforcement frame respectively, each with a space formed between the frame outer surface and the engaging wall for accommodating the outward engaging projections of the tenon portion, the upper engaging wall being formed with one vertically elongated hole, the elongated hole having a length larger than the largest width of the tenon portion including the outward engaging projections and a constant width over the entire length, the width of the elongated hole being smaller than the largest width of the tenon portion including the outward engaging projections and larger than the smallest width of the tenon portion exclusive of the outward engaging propjections, the lower engaging wall being formed in its lower edge with one cutout having a width equal over the entire length thereof to the width of the elongated hole.

18. A sealed container as defined in any one of claims 10 to 17 wherein the body, the top closure and the bottom closure are integrally formed from a single laminate blank made chiefly of paper and having a thermoplastic synthetic resin layer providing the outer surface of the container, and the upper, intermediate and lower reinforcement frames are made of a thermoplastic resin and are each attached at a plurality of locations lengthwise thereof to the outer surface of the body with a hotmelt adhesive applied in the form of spots.

19. A sealed container as defined in claim 10 or 14 wherein the spout means comprises a tubular member projecting upward from the top wall through a hole formed therein and having an externally threaded upper end, the tubular member being provided on the outer periphery of its lower end with a flange secured to the inner surface of the top wall, and an internally threaded cap screwed on the threaded upper end of the tubular member, the tubular member having in its interior a closure wall provided with an opening forming annular portion of a reduced thickness and with a knob inwardly of the annular portion.

* * * * *